US007669351B1

(12) United States Patent
Ghotbi

(10) Patent No.: US 7,669,351 B1
(45) Date of Patent: Mar. 2, 2010

(54) SANITARY SHOE COVER DISPENSER

(76) Inventor: Adam Ghotbi, 5935 E. 55th St., Tulsa, OK (US) 74135

( * ) Notice: Subject to any disclaimer, the term of this patent is extended or adjusted under 35 U.S.C. 154(b) by 893 days.

(21) Appl. No.: 11/355,406

(22) Filed: Feb. 16, 2006

(51) Int. Cl.

| | |
|---|---|
| ***A43B 3/16*** | (2006.01) |
| ***A43B 3/02*** | (2006.01) |
| ***A43B 5/18*** | (2006.01) |
| ***A43D 89/00*** | (2006.01) |
| ***A43B 1/02*** | (2006.01) |

(52) U.S. Cl. ..... 36/7.1 R; 12/1 R; 36/9 R

(58) Field of Classification Search ..... 12/1 R; 221/174; 36/7.1 R, 9 R

See application file for complete search history.

(56) References Cited

U.S. PATENT DOCUMENTS

| | | | | |
|---|---|---|---|---|
| 5,822,884 | A | 10/1998 | Roeder | |
| 5,842,290 | A | 12/1998 | Mills | |
| 6,209,227 | B1 | 4/2001 | Swango | |
| D455,894 | S | 4/2002 | Overfield | |
| 6,532,686 | B2 | 3/2003 | Gultekin | |
| 6,584,704 | B2 | 7/2003 | March | |
| 6,625,903 | B2 | 9/2003 | Swango | |
| D506,604 | S | 6/2005 | Parker, Jr. et al. | |
| 6,955,274 | B2 * | 10/2005 | Delery et al. | 220/9.4 |
| 6,994,532 | B2 * | 2/2006 | Vachon et al. | 425/2 |
| 7,108,154 | B1 * | 9/2006 | Thompson | 221/33 |
| 2004/0245720 | A1 * | 12/2004 | Grauzer et al. | 273/149 R |
| 2006/0144879 | A1 * | 7/2006 | Hu | 223/111 |
| 2008/0000035 | A1 * | 1/2008 | Levine et al. | 12/1 R |
| 2008/0237277 | A1 * | 10/2008 | Xu | 222/526 |

FOREIGN PATENT DOCUMENTS

| | | | |
|---|---|---|---|
| GB | 2446669 A | * | 8/2008 |

* cited by examiner

*Primary Examiner*—Gene O. Crawford
*Assistant Examiner*—Rakesh Kumar
(74) *Attorney, Agent, or Firm*—Gable & Gotwals

(57) ABSTRACT

A dispenser for a sanitary shoe cover holds a stack of shoe covers with their resiliently elastic mouths in a stretched-open condition in a storage zone. Sanitary covers are carried individually from the storage zone stack to a dispensing zone. The individual shoe cover is automatically released from the dispenser in response to downward insertion of the shoe-covered foot into the stretched-open shoe cover, permitting the resiliently elastic mouth to gather into abutment with the shoe-covered foot. The process is automatically repeated to carry another individual cover to the dispensing zone in response to the upward removal of the sanitary-covered, shoe-covered foot from the dispensing zone.

7 Claims, 4 Drawing Sheets

SANITARY SHOE COVER DISPENSER

BACKGROUND OF THE INVENTION

This invention relates generally to sanitary shoe covers and more particularly concerns an automatic dispenser for shoe covers of the surgical type commonly used to safeguard operating room environments against contamination.

Surgical type shoe covers are used by health care professionals in a number of settings. Similar covers are used, for example, by real estate offices during house showings, by construction workers to protect completed work and by food preparation and service employees. The cover material typically consists of polyolefin fibers heated and pressed together to form a soft, fluid repellent fabric, but could also be made of polyethylene. The cover has a mouth sized to be opened to a size that allows the entry of the foot into the cover toe first. The covers are generally stored in a cardboard box and manually removed from the box and applied to the shoe-covered foot. Some covers are stored in a dispenser, similar to a roll-tape dispenser, for manual removal of individual covers from the roll.

The manual dispensing and application of the cover to the shoe-covered foot is a major drawback in the use of the cover. During manual removal of the cover from the box or dispenser, contaminants on the hands of the user can be transferred to the cover being removed and applied as well as to other covers that may be contacted during the process. Furthermore, observation of the manual cover application process by patients, customer or others does not instill an attitude of confidence in the overall sanitary condition of the premises or the personnel working on the premises. Nor, for that matter, does observation of the storage of the covers in seemingly all to accessible cardboard boxes or non-enclosed roll dispensers.

It is, therefore, an object of this invention to provide a sanitary shoe cover dispenser which stores the covers in a substantially enclosed environment. It is also an object of this invention to provide a sanitary shoe cover dispenser which does not require manual contact with the cover during removal of the cover from the dispenser. Another object of this invention is to provide a sanitary shoe cover dispenser which does not require manual contact with the cover during application of the cover to a shoe-covered foot. A further object of this invention is to provide a sanitary shoe cover dispenser which fosters an attitude of confidence in the attentiveness to maintaining a sanitary environment. Yet another object of this invention is to provide a sanitary shoe cover dispenser which automatically mechanically positions a cover for insertion of a shoe-covered foot. And it is an object of this invention to provide a non-manual method for applying a stored sanitary shoe cover to a shoe-covered foot.

SUMMARY OF THE INVENTION

In accordance with the invention, a dispenser for sanitary shoe covers includes an array of vertical shoe cover storage posts, an array of vertical shoe cover dispensing posts and an array of shoe cover transfer ramps. Each shoe cover has a plurality of rings connected along the perimeter of its resiliently elastic mouth. The array of storage posts is fixed. The rings are stacked to slide on their corresponding storage posts to mechanically hold the shoe covers in a stretched-open condition in a storage zone. The array of dispensing posts travels in horizontal reciprocal motion between a dispensing zone and the storage zone. In the storage zone, the fixed array of storage posts and the moving array of dispensing posts can come into registration in axial alignment so that the rings of one of the shoe covers can be transferred from the array of storage posts to the array of dispensing posts. The array of dispensing posts can then carry the stretched-open cover to the dispensing zone. The array of transfer ramps travels into and out of the storage zone in horizontal reciprocal motion transverse to the motion of the array of dispensing posts. When the array of dispensing posts is not in registration with the array of storage posts in the storage zone, the array of transfer ramps and the array of storage posts are registered in axial alignment so that the array of transfer ramps mechanically supports the stretched-open shoe covers in stacked arrangement. After the array of dispensing posts comes into registration with the array of storage posts in the storage zone, the array of transfer ramps is withdrawn, permitting each stack of rings to rest on the top of its corresponding dispensing post. After the rings are stacked on the array of dispensing posts in the storage zone, the array of transfer ramps returns to registration with both arrays of posts. The transfer ramps separate the rings of the lowermost cover from those of the penultimate cover, snap the rings of the lowermost cover onto the array of dispensing posts and support the rings of the penultimate cover and those stacked above it. The array of dispensing posts can then be withdrawn to the dispensing zone, carrying the cover with its resiliently elastic mouth in the stretched-open condition for downward insertion of a shoe-covered foot. The shoe cover rings are automatically released from the dispensing posts in response to downward insertion of the shoe-covered foot into the stretched-open shoe cover. This permits the resiliently elastic mouth of the shoe cover to gather into abutment with the shoe-covered foot. The process is repeated to automatically mechanically support another shoe covering in the dispensing zone in response to the upward removal of the now sanitary-covered shoe-covered foot from the dispensing zone.

In a preferred embodiment, each transfer ramp has a yoke on which its corresponding cover rings can be stacked when the storage post and ramp arrays are in registration. Each dispensing post has an upper shelf on which its corresponding rings can be stacked when the storing post and dispensing post arrays are in registration and the ramp array is withdrawn from registration. Each ramp yoke has tips contoured to slide between the lowermost and penultimate rings of its stack during motion of the ramp array into registration with the dispensing post array. The rings are radially split and each yoke has wedges contoured to snap the lowermost ring downwardly over the upper shelf during motion of the ramp array into registration with the dispensing post array. Each dispensing post also has a lower shelf on which the corresponding ring of the lowermost cover can be seated after the ring is snapped over the upper shelf. The split in the rings also allows the rings to disengage from their dispensing posts as the user's shoe-covered foot is inserted into the sanitary cover.

BRIEF DESCRIPTION OF THE DRAWINGS

Other objects and advantages of the invention will become apparent upon reading the following detailed description and upon reference to the drawings in which.

Figures 1A, 1B, 2A:
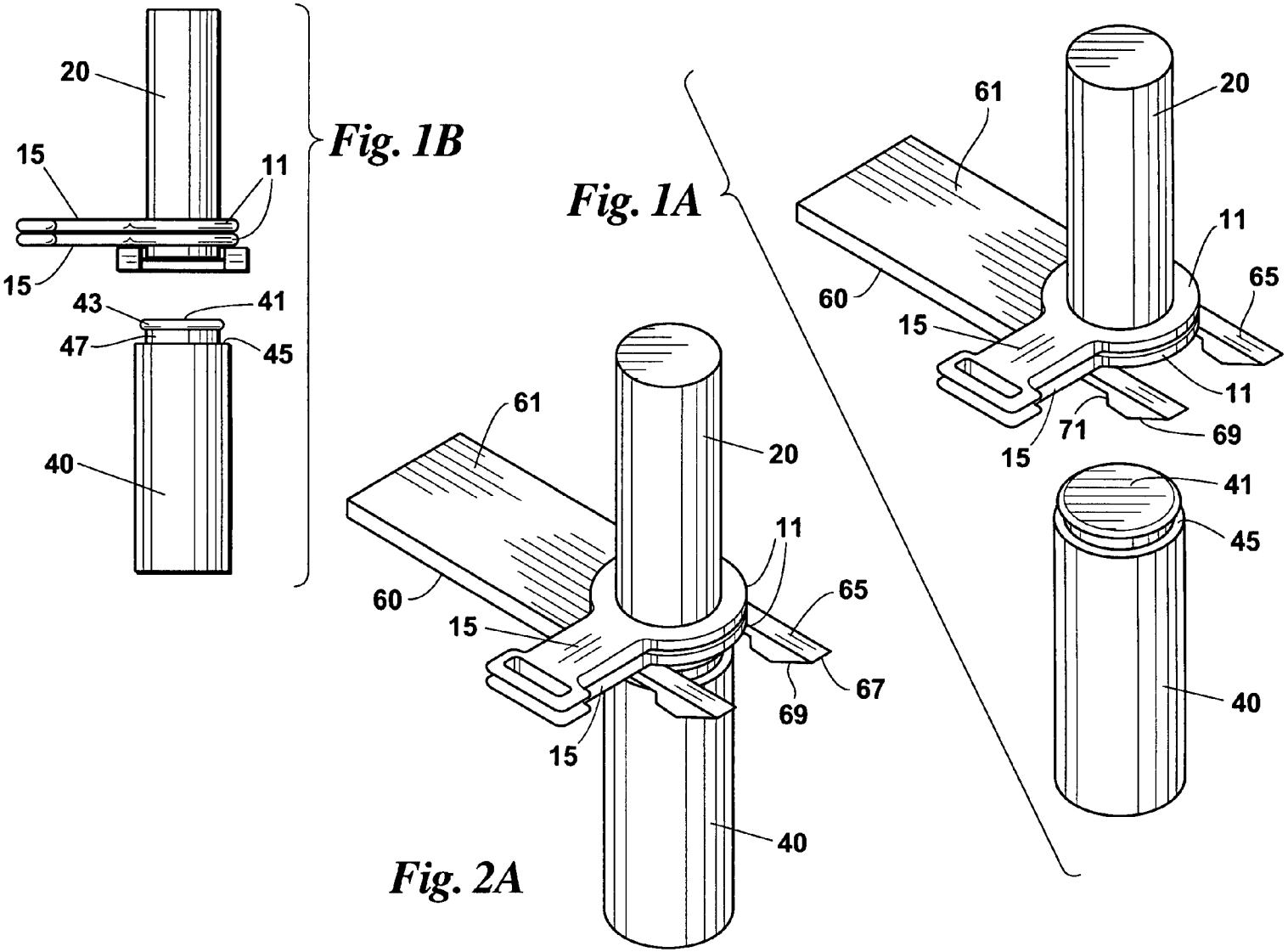
FIG. 1A is an isometric view of the dispenser in the first stage of the shoe cover transfer process.
FIG. 1B is a side elevation view of the dispenser in the first stage of the shoe cover transfer process.
FIG. 2A is an isometric view of the dispenser in the second stage of the shoe cover transfer process.

While the invention will be described in connection with a preferred embodiment thereof, it will be understood that it is not intended to limit the invention to those embodiments or to the details of the construction or arrangement of parts illustrated in the accompanying drawings.

DETAILED DESCRIPTION

FIGS. 1A and 1B through 5A and 5B illustrate the invention in its five operational stages. FIGS. 6A and 6B illustrate a sanitary shoe cover 10 for use with the dispenser. The shoe cover dispenser consists of arrays of corresponding components. In FIGS. 1A and 1B through 5A and 5B, the corresponding components of only a single array are illustrated. Looking at FIGS. 6A and 6B, the shoe cover 10 is seen to have four rings 11 along the perimeter of its mouth 13. This is a preferred configuration of the shoe cover 10, but other shoe covers may have more or less rings 11 on their perimeters. However, for every ring 11 there will be a corresponding number of dispenser components. Looking at FIGS. 1A and 1B through 5A and 5B, those components will include an array of vertical shoe cover storage posts 20, an array of vertical shoe cover dispensing posts 40 and an array of shoe cover transfer ramps 60.

Shoe Covers

Looking at FIGS. 6A and 6B, each shoe cover 10 has a plurality of rings 11 connected along the perimeter of a resiliently elastic mouth 13 of the cover 10. The covers 10 are typically made with material consisting of polyolefin fibers heated and pressed together to form a soft, fluid repellent fabric. They may be made using polyethylene. As shown, the mouth 13 of the cover 10 is hemmed at its perimeter with an elastic band 14 inside the hem. The elastic mouth 13 of the cover 10 is sized to open sufficiently to receive a shoe sole by bottom-first insertion. The rings 11 are connected to the cover 10 by D-ring type tabs 15 and loops 16 of cloth sewn to the hem. The rings 11 are split 17 diametrically opposite the tabs 15 and have an outer radius 19.

Storage Posts

Looking at FIGS. 1A and 1B through 5A and 5B, the storage posts 20 are vertically oriented and have an outer diameter such that the rings 11 can be stacked to slide on the posts 20. The height of the posts 20 is sufficient to stack a number of rings 11. The array of storage posts 20 is fixed in spaced relationship so as to mechanically hold the shoe covers 10 in the stretched-open condition shown in FIG. 6A in a storage zone, the rings 11 of each shoe cover 10 being stacked to slide on their corresponding storage posts 20 of the storage post array. The cover 10, rings 11 and storage posts 20 are preferably part of a replacable cartridge (not shown) which, when loaded in the dispenser, biases the rings 11 downwardly toward the bottom of the storage posts 20. The storage zone is a vertical column within the boundaries established by the array of storage posts 20. For a four ring shoe cover 11, the storage zone is essentially a column of rectangular cross-section. It is referenced for the purpose of identifying the place at which an operational event is occurring in the dispenser.

Dispensing Posts

The dispensing posts 40 are vertically oriented. They have an upper shelf 41 of diameter greater than the outer diameter of the rings 11. The upper shelf 41 is the top of an annular flange 43 which extends over a lower shelf 45. The lower shelf 45 has an outer diameter greater than the outer diameter of the flange 43. Between the flange 43 and the lower shelf 45, the post 40 has a diameter 47 on which a ring 11 can slide, preferably the same diameter as the storage post 20. The array of dispensing posts 40 travels in horizontal reciprocal motion between a dispensing zone and the storage zone. The posts 40 are fixed in spaced apart relationship in an array which can be registered in axial alignment with the array of storage posts 20. Preferably, the array of dispensing posts 40 are fixed to a sliding platform (not shown) for reciprocation by mechanical, hydraulic or other drive system (not shown) between the storage zone and the dispensing zone. The dispensing zone column is within the boundaries established by the array of dispensing posts 40 when the platform has moved the array of dispensing posts 40 to the shoe-covered foot insertion area of the dispenser. It is referenced for the purpose of identifying the place at which an operation event is occurring in the dispenser. The arrays of storage and dispensing posts 20 and 40 come into registration in axial alignment in the storage zone so that the rings 11 of the lowermost shoe cover 10 can be transferred from the array of storage posts 20 to the array of dispensing posts 40 to carry the stretched-open cover 10 to the dispensing zone.

Transfer Ramps

The transfer ramps 60 are elongated members with a horizontal top face 61. A central cut-out 63 at a leading end of the ramp 60 forms a yoke 65 with tips 67. The ramp 60 tapers to provide wedges 69 on the underside of the ramp 60. The central cut-out 63 is wide enough to pass around its storage post 20 and narrow enough to permit the ramp 11 to be attached on the yoke 65. The top face 61 of the ramp 60 is positioned so that the tips 67 are in horizontal alignment between the lowermost and penultimate rings 11 on their storage post 20. The thickness of the ramp 60 is such that the wedges 69 extend below the upper shelf 41 of their dispensing post 40. The ramp 60 also has a bottom cut-out 71 in the yoke 65 into which the top of the dispensing post 40 can pass. The array of transfer ramps 60 travels in horizontal reciprocal motion transverse to the motion of the array of dispensing posts 40 into and out of the storage zone. The ramps 60 may, for example, be synchronously independently driven into registration with the posts 20 and 40 by a mechanical or hydraulic drive system or the like (not shown).

Operation

The refill cartridge (not shown) contains multiple storage posts 20. The covers 10 are stacked in the cartridge with their rings 11 slidably engaged on the storage posts 20. The storage posts 20 are spaced in an array that holds the mouths 13 of the covers 10 in the stretched-open condition shown in FIG. 6A.

In the first stage of operation, seen in FIGS. 1A and 1B, the rings 11 are slidably mounted on their corresponding storage posts 20 and are supported in stacked relationship on the yoke 65 of their corresponding transfer ramp 60 in the storage zone. The dispensing post is in the dispensing zone. As shown, the central cut-out 63 defining the yoke 65 of the ramp 60 receives the storage post 20 so that the stacked rings 11 are supported on top of the yoke 65.

Figure 2B:
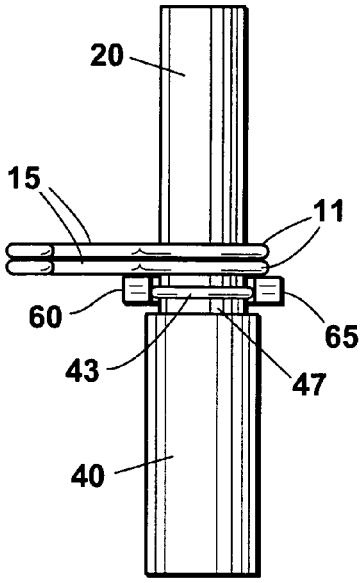
FIG. 2B is a side elevation view of the dispenser in the second stage of the shoe cover transfer process.

In the second stage of operation, seen in FIGS. 2A and 2B, the dispensing post 40 has moved directly under the storage post 20 and is in the proper position to receive its lowest ring 11 of the stack of covers 10. The stack of rings 11 is still supported by the yoke 65 of the ramp 60 but the dispensing post 40 has moved into the storage zone. The flange 43 on the top of the dispensing post 40 is received in the bottom cut-out 71 of the ramp 60. The storage post 20, dispensing post 40 and ramp 60 are all registered in axial alignment, considering the radial center of the central cut-out 63 to be on the registration axis.

Figure 3A:
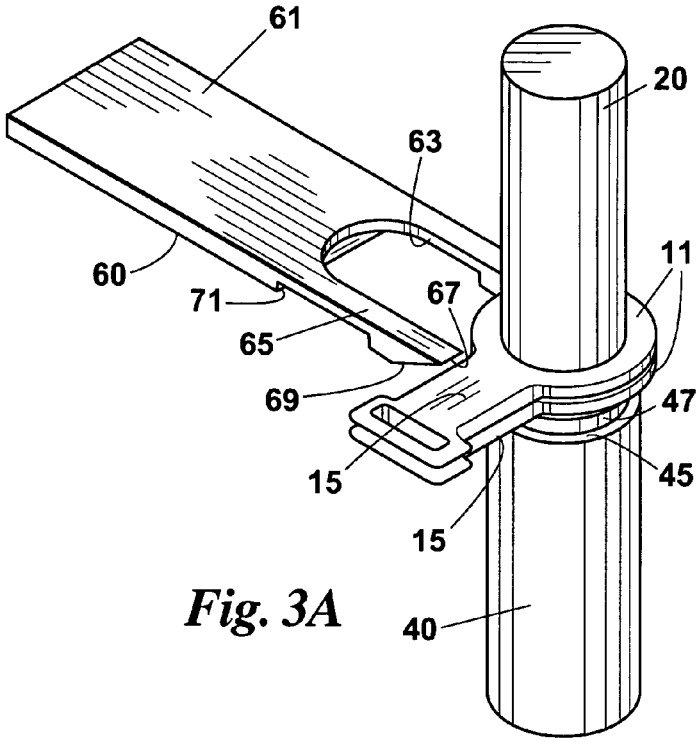
FIG. 3A is an isometric view of the dispenser in the third stage of the shoe cover transfer process.
Figure 3B:
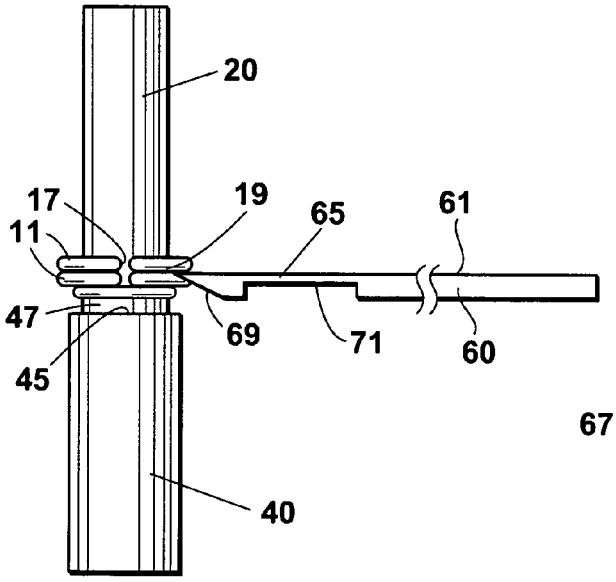
FIG. 3B is a side elevation view of the dispenser in the third stage of the shoe cover transfer process.

In the third stage of operation, seen in FIGS. 3A and 3B, the transfer ramp 60 has been withdrawn to allow the rings 11 to fall onto the upper shelf 41 of the dispensing post 40. The lowest ring 11 comes to rest on the top of the dispensing post 40. The posts 40 and 60 remain registered in axial alignment and the top face 61 of the ramp 60 is horizontally positioned to intersect the space between the outside radii 19 on each of the rings 11.

Figure 4B:
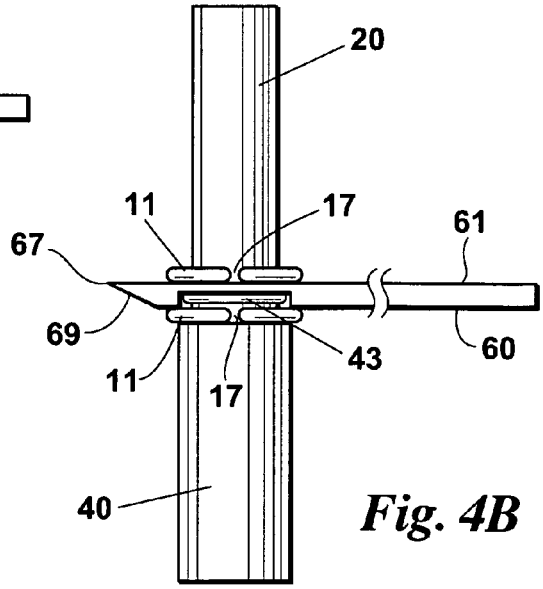
FIG. 4B is a side elevation view of the dispenser in the fourth stage of the shoe cover transfer process.
Figure 4A:
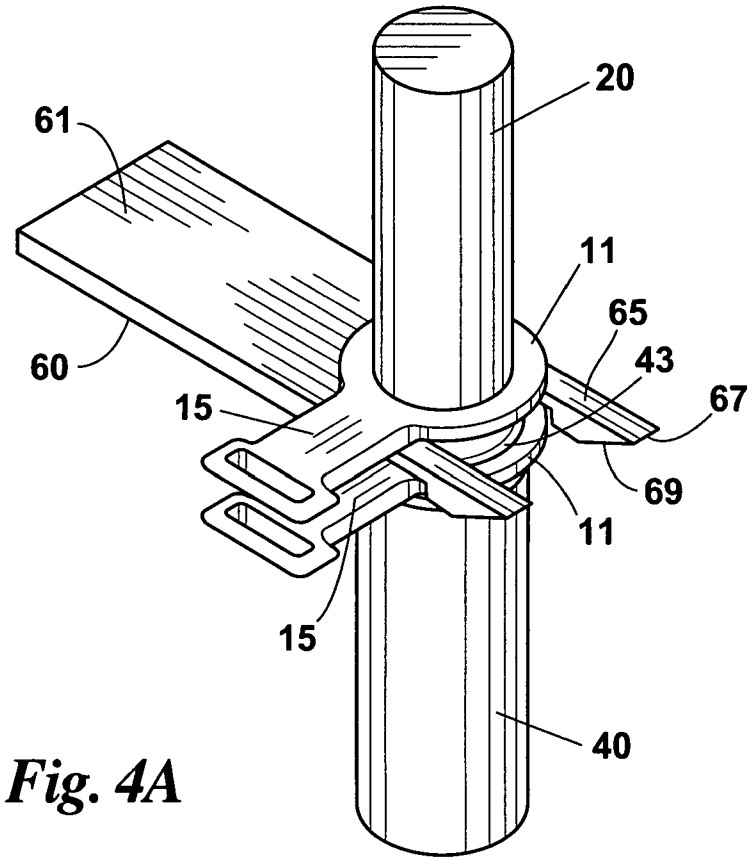
FIG. 4A is an isometric view of the dispenser in the fourth stage of the shoe cover transfer process.

In the fourth stage of operation, seen in FIGS. 4A and 4B, the transfer ramp 60 has moved back into registration with the storage and dispensing posts 20 and 40. In the course of coming into registration, the horizontal positioning of the ramp tips 67 has allowed the ramp 60 to act only upon the lowest ring 11 while holding the rest of the rings 11 above the ramp 60. The tips 67 have guided the yoke 65 between the outside radii 19 of the lowermost and penultimate rings 11. The wedges 69 have forced the lowermost ring 11 to expand at its split 17 to a diameter which has passed over the flange 43 of the dispensing post 40. The lowermost ring 11 has snapped back to its normal diameter and is seated on the lower shelf 45 of the dispensing post 40.

Figure 5A:
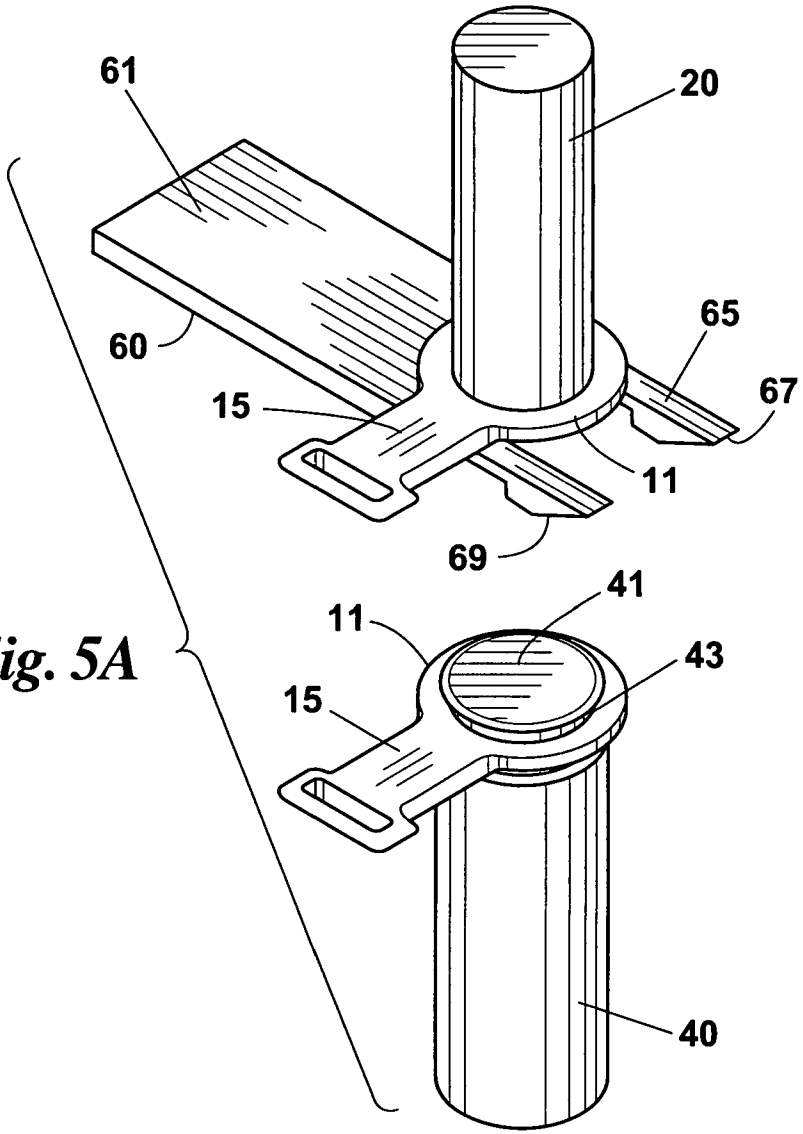
FIG. 5A is an isometric view of the dispenser in the fifth stage of the shoe cover transfer process.
Figure 5B:
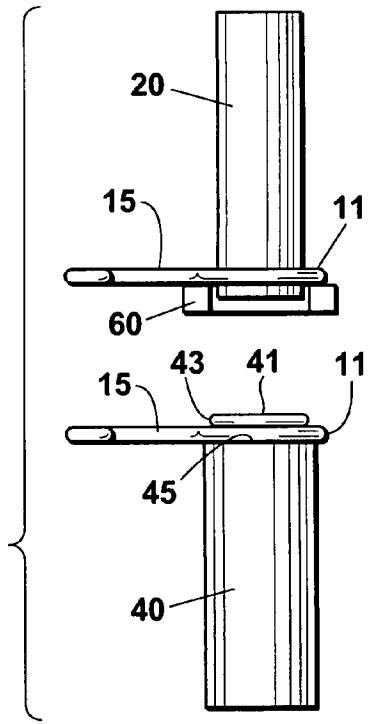
FIG. 5B is a side elevation view of the dispenser in the fifth stage of the shoe cover transfer process.
Figure 6A:
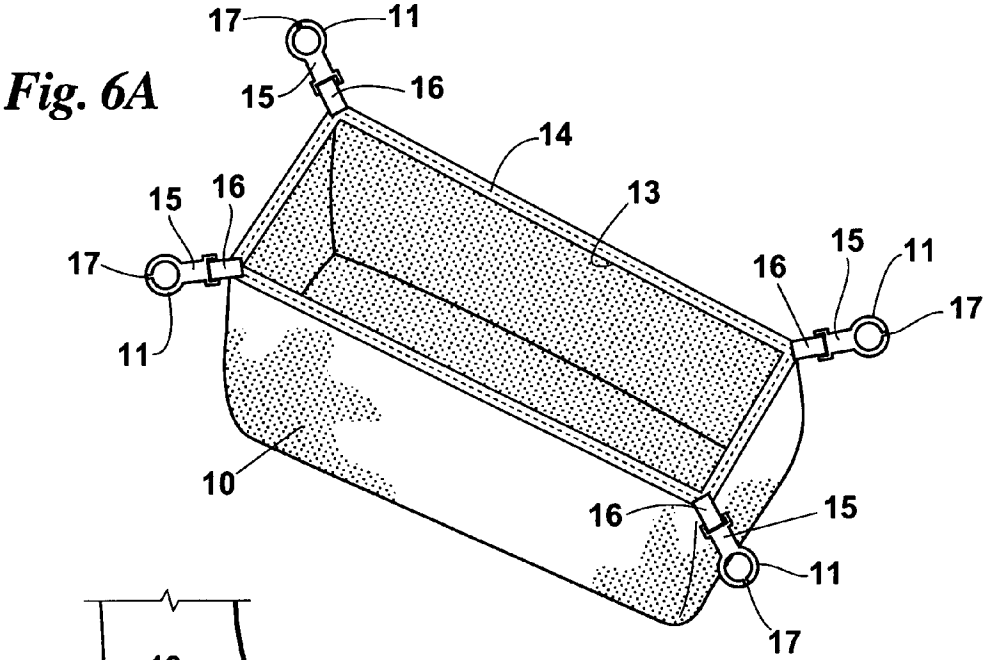
FIG. 6A is an isometric view of a sanitary shoe cover for use with the dispenser in condition ready for insertion of a shoe covered foot.
Figure 6B:
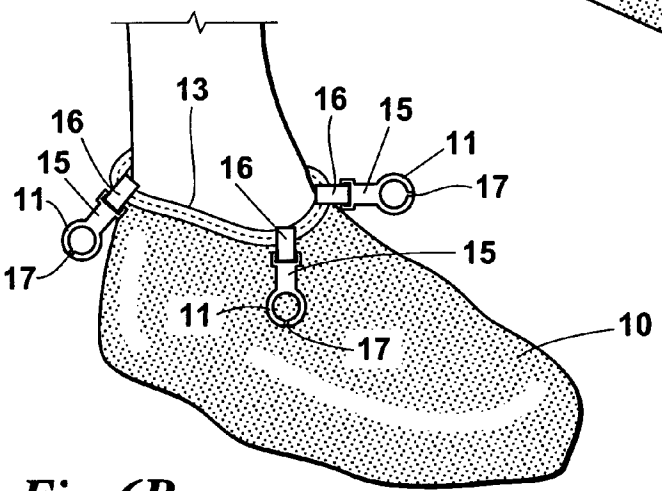
FIG. 6B is an isometric view of the sanitary shoe cover of FIG. 6A disposed on the shoe covered foot.

In the fifth stage of operation, seen in FIGS. 5A and 5B, the dispensing post 40 has reciprocated from the storage zone to the dispensing zone. The transfer ramp 60 holds up the rings 11 which remain on the storage post 20. The dispenser 40 has carried the transferred ring 11 to the dispensing zone. When the user places a shoe inside the area and steps downward, this action will apply force upon all of the rings 11 of the cover 10 and cause the splits 19 to open, allowing the rings 11 to pop off their corresponding dispensing posts 40. The elastic 14 in the mouth 13 of the cover 10 closes the cover 10 over the shoe or foot, as seen in FIG. 6B. A switch (not shown) is actuated when the foot is removed to cycle the cover transfer sequence to load the next stretched-open cover 10 in the dispensing zone.

Consider the operation of full arrays of storage posts 20, dispensing posts 40 and ramps 60. When the array of dispensing posts 40 is not in registration with the array of storage posts 20 in the storage zone, the array of transfer ramps 60 and the array of storage posts 20 are in registration in axial alignment and the array of transfer ramps 60 mechanically supports the stretched-open shoe covers 10 in stacked arrangement. After the array of dispensing posts 40 comes into registration with the array of storage posts 20 in the storage zone, the array of transfer ramps 60 is withdrawn, permitting the stack of rings 11 to rest on the tops of the array of dispensing posts 40. After the rings 11 are stacked on the array of dispensing posts 40 in the storage zone, the array of transfer ramps 60 returns to registration with both arrays of posts 20 and 40, separating the rings 11 of the lowermost cover 10 from those of the penultimate cover 10, snapping the rings 11 of the lowermost cover 10 onto the array of dispensing posts 40 and supporting the rings 11 of the penultimate cover 10 and those stacked above it. The array of dispensing posts 40 can then be withdrawn to the dispensing zone, carrying the cover 10 with its resiliently elastic mouth 13 in a stretched-open condition, for downward insertion of a shoe-covered foot. The shoe cover is automatically released from the dispensing posts 40 in response to downward insertion of the shoe-covered foot into the stretched-open shoe covering 10. This permits the resiliently elastic mouth 13 to gather into abutment with the shoe-covered foot. The process is repeated to automatically mechanically support another shoe covering 10 in the dispensing zone in response to the upward removal of the sanitary-covered shoe-covered foot from the dispensing zone. There are typically four rings 11 per cover 10 with four storage posts 20 in the storage post array contained in the refill cartridge. Four dispensing posts 40 are preferably fastened to a moving platform that is reciprocated between the storage and dispensing zones. Four transfer ramps 60 support the rings 11 whenever the dispensing posts 40 are not located directly underneath the storage posts 20. The transfer ramps 60 then support either the lowermost or the penultimate rings 11 and rest of the rings 11 above them, depending on whether the lowermost rings 11 have been transferred to the dispensing posts 40.

Thus, it is apparent that there has been provided, in accordance with the invention, a sanitary shoe cover dispenser and method for applying the cover to a shoe which is being worn at the time of dispensing that fully satisfy the objects, aims and advantages set forth above. While the dispenser and method have been described in conjunction with specific embodiments thereof, it will be evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A dispenser for sanitary shoe covers comprising:

a plurality of vertical shoe cover storing posts arranged in an axially spaced array;

a plurality of rings on each shoe cover, one said ring of each cover being slidably engagable on a corresponding one of said storing posts;

a plurality of vertical shoe cover dispensing posts arranged in an axially spaced array, said dispensing post array being adapted for horizontal reciprocal motion into and out of registration with said storing post array, each said dispensing post having means thereon for supporting said shoe cover rings when said storing post and dispensing post arrays are in registration; and a plurality of shoe cover transfer ramps arranged in an axially spaced array, said ramp array being adapted for horizontal reciprocal motion into and out of registration with said storing post array, said ramp array motion being transverse to said dispensing post array motion, each of said transfer ramps having first means for supporting corresponding ones of said shoe cover rings when said storing post and dispensing post arrays are not in registration and second means for separating corresponding ones of said lowermost of said shoe cover rings from a penultimate ring and transferring said lowermost ring to its corresponding said dispensing post supporting means when said storing post and dispensing post arrays are in registration.

2. A dispenser according to claim 1, each said ramp supporting means comprising a yoke on which said rings are stackable when said storing post and said ramp are in registration.

3. A dispenser according to claim 2, each said dispensing post supporting means comprising an upper shelf on which corresponding ones of said rings are stacked when said storing post and dispensing post arrays are in registration and said storing post and said ramp are not in registration.

4. A dispenser according to claim 3, each said ramp separating means comprising tips on said yoke contoured to slide between corresponding ones of said lowermost and penultimate rings during motion of said ramp into registration with said dispensing post.

5. A dispenser according to claim 4, said rings being radially split and each said ramp transferring means comprising wedges on said yoke contoured to snap a corresponding one of said lowermost rings downwardly over a corresponding one of said dispensing post upper shelves during motion of said ramp into registration with its corresponding dispensing post.

6. A dispenser according to claim 5, each said dispensing post supporting means further comprising a lower shelf on which a corresponding one of said lowermost rings is seatable after said lowermost ring is snapped over said upper shelf.

7. A dispenser for sanitary shoe covers comprising:

a plurality of vertical shoe cover storing posts arranged in an axially spaced array;

a plurality of rings on each shoe cover, one said ring of each cover being slidably engagable on a corresponding one of said storing posts;

a plurality of vertical shoe cover dispensing posts arranged in an axially spaced array, said dispensing post array being adapted for horizontal reciprocal motion into and out of registration with said storing post array, each said dispensing post having first means thereon for supporting said shoe cover rings in a stack when said storing post and dispensing post arrays are in registration and second means thereon for supporting a lowermost of said shoe cover rings when said storing post and dispensing post arrays are not in registration; and a plurality of shoe cover transfer ramps arranged in an axially spaced array, said ramp array being adapted for horizontal reciprocal motion into and out of registration with said storing post array, said ramp array motion being transverse to said dispensing post array motion, each of said transfer ramps having first means for supporting corresponding ones of said shoe cover rings in a stack when said storing post and dispensing post arrays are not in registration and second means for separating corresponding ones of said lowermost of said shoe cover rings from a penultimate ring and transferring said lowermost ring to its corresponding said dispensing post second means when said storing post and dispensing post arrays are in registration.

* * * * *